US006842915B2

(12) United States Patent
Turner et al.

(10) Patent No.: US 6,842,915 B2
(45) Date of Patent: Jan. 18, 2005

(54) DEVICE AND METHOD FOR SECURING APPAREL TO PROTECTIVE EQUIPMENT

(75) Inventors: David Turner, Portland, OR (US); Thomas Creighton, Portland, OR (US)

(73) Assignee: Nike, Inc., Beaverton, OR (US)

( * ) Notice: Subject to any disclaimer, the term of this patent is extended or adjusted under 35 U.S.C. 154(b) by 30 days.

(21) Appl. No.: 10/033,818

(22) Filed: Dec. 20, 2001

(65) Prior Publication Data

US 2003/0115663 A1 Jun. 26, 2003

(51) Int. Cl.[7] ..... A41D 13/00
(52) U.S. Cl. ..... 2/459
(58) Field of Search ..... 2/459, 461, 462, 2/463, 69, 69.5, 94, 113–115, 44, 45, 267, 268, 2.5, 75, 80, 16, 22, 24, 455, 456, 247

(56) References Cited

U.S. PATENT DOCUMENTS 2,717,437 A * 9/1955 Mestral ..... 428/92
3,009,235 A * 11/1961 Mestral ..... 428/86
3,257,666 A * 6/1966 Hoffman ..... 2/459
4,249,268 A * 2/1981 Berler ..... 2/115
4,486,901 A * 12/1984 Donzis ..... 2/462
4,610,034 A * 9/1986 Johnson ..... 2/459
5,054,127 A * 10/1991 Zevchak ..... 2/247
5,390,368 A * 2/1995 Chang ..... 2/462
5,694,651 A * 12/1997 Thomas ..... 2/69
5,706,521 A * 1/1998 Haney ..... 2/160
5,718,589 A * 2/1998 McCracken et al. ..... 434/159
5,742,939 A * 4/1998 Williams ..... 2/69
6,060,408 A 5/2000 Monica

* cited by examiner

*Primary Examiner*—Tejash Patel
(74) *Attorney, Agent, or Firm*—Banner & Witcoff, Ltd.

(57) ABSTRACT

A system and method of securing apparel to protective equipment is provided. In particular, the system includes an apparel attachment member defining a first side having an adhesive coating that secures the apparel attachment member to the protective equipment, and a second side having a plurality of hooks that removeably engage a plurality of loops located on the apparel.

14 Claims, 3 Drawing Sheets

DEVICE AND METHOD FOR SECURING APPAREL TO PROTECTIVE EQUIPMENT

FIELD OF THE INVENTION

The present invention relates generally to a system for securing apparel to protective equipment, and more particularly, to a system which uses hook and loop connections for removably attaching the apparel to the protective equipment.

BACKGROUND OF THE INVENTION

To protect athletes from injury, players of football, hockey, lacrosse, soccer and other contact sports wear protective equipment, such as shoulder pads, rib pads, back pads, and shin pads. This protective equipment is typically worn underneath outer apparel such as sports jerseys. In order to enhance performance, athletes desire an attachment system between the apparel and the protective equipment that eliminates movement between the apparel and the underlying protective equipment. Known systems for attaching apparel to protective equipment include the use of two-sided tape, as disclosed in U.S. Pat. No. 6,060,408 to Monica.

The Monica patent discloses a double-sided tape having two adhesive sides. A first adhesive side contacts and adheres to an underlying protective pad and a second adhesive side contacts and adheres to overlying apparel. The system provided in the Monica patent, however, has many drawbacks. For instance, athletes typically remove the outer apparel from the underlying protective equipment after each sporting event or game. Each removal reduces the adhesiveness or stickiness of the two-sided tape. In addition, the outer apparel and underlying protective equipment are often exposed to moisture and dirt since contact sports often take place outdoors. Moisture and dirt will inhibit the adhesiveness of the two-sided tape. As a result, the Monica system requires replacement after only a few uses and after limited exposure to moisture and/or dirt. Frequent replacement of two-sided tape, in turn, requires considerable manual effort and results in increased maintenance time and expense. Furthermore, the two-sided tape system of Monica lacks the shear strength required for effective use. Although the two-sided tape system reduces movement between the apparel and underlying protective equipment, the adhesiveness of the system fails when subjected to high shear stress caused by a hard pull, yank, or tug of the outer apparel. Under these conditions, which frequently occur in many contact sports, the outer apparel tears away from the underlying protective equipment, which is undesirable.

Consequently, there exists a genuine need for an apparel attachment system that overcomes the disadvantages of the prior art systems. The present invention solves the aforementioned problems of the prior art.

BRIEF SUMMARY OF THE INVENTION

Accordingly, an object of the present invention is to provide an apparel attachment system that prevents movement between the apparel and the protective equipment while being subjected to high shear stresses caused by the apparel being grabbed, yanked, or pulled.

Another object of the present invention is to provide an apparel attachment system that remains effective after repeated use and exposure to moisture and dirt.

Still another object of the present invention is to provide an apparel attachment system that reduces maintenance time and expense.

To achieve the foregoing and other objectives, one aspect of the present invention relates to an apparel attachment system for attaching apparel, such as a sports jersey, to protective equipment, and is particularly well adapted to attaching football jerseys to underlying shoulder pads and rib pads. The attachment system includes an apparel attachment member that may be die cut to a desired shape to configure to a particular protective pad size.

In an exemplary embodiment, the attachment member of the present invention has a first side and a second side. The first side of the attachment member has an adhesive coating and the second side has a plurality of hooks. In operation, the adhesive coating of the first side of the attachment member contacts and adheres to an underlying protective pad, such as, a shoulder pad. The plurality of hooks on the second side of the attachment member contact and removeably engage a plurality of loops on the inside surface of an outer apparel. The apparel attachment system secures the apparel to the protective equipment, thereby preventing movement between the apparel and the protective equipment.

Another aspect of the present invention relates to a method of attaching apparel to protective equipment by providing an apparel attachment member defining a first side and a second side, wherein the first side has an adhesive coating and the second side has a plurality of hooks. The method includes contacting the adhesive coating of the first side of the attachment member with the protective pad and contacting the second side of the attachment member with the apparel.

These and other features of the present invention may best be understood with reference to the accompanying drawings and in the following detailed description of the invention.

BRIEF DESCRIPTION OF THE DRAWINGS

In the drawings, the following figures have the following general nature.

DETAILED DESCRIPTION OF THE INVENTION

Figure 1:
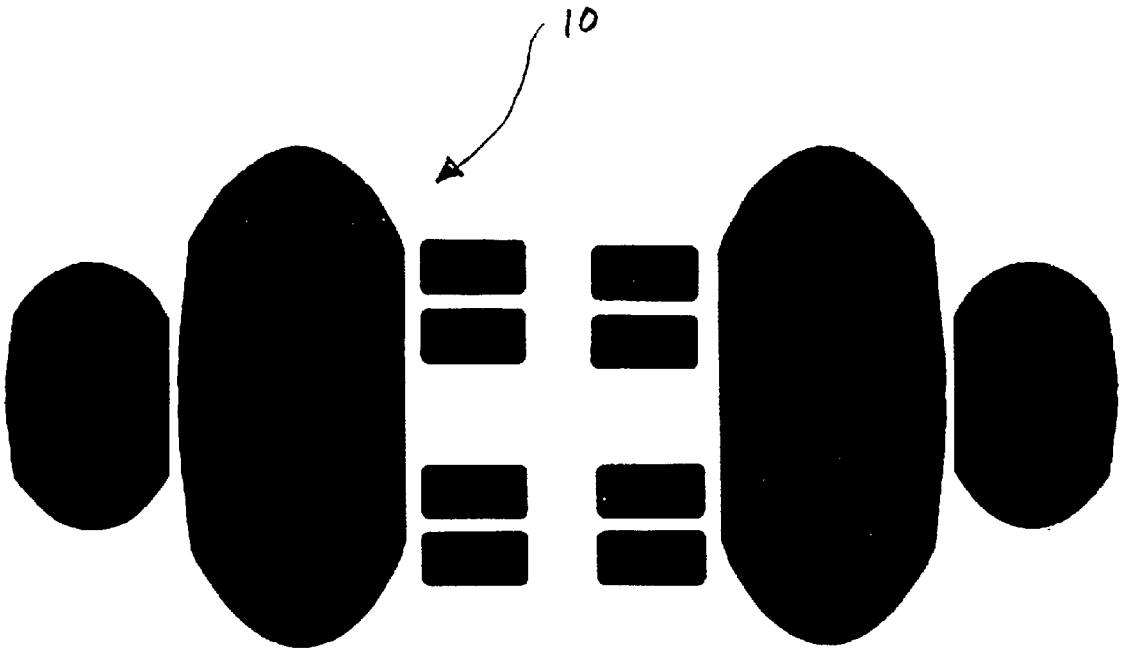
FIG. 1 depicts die-cut apparel attachment members conforming substantially to football shoulder pads.
Figure 2:
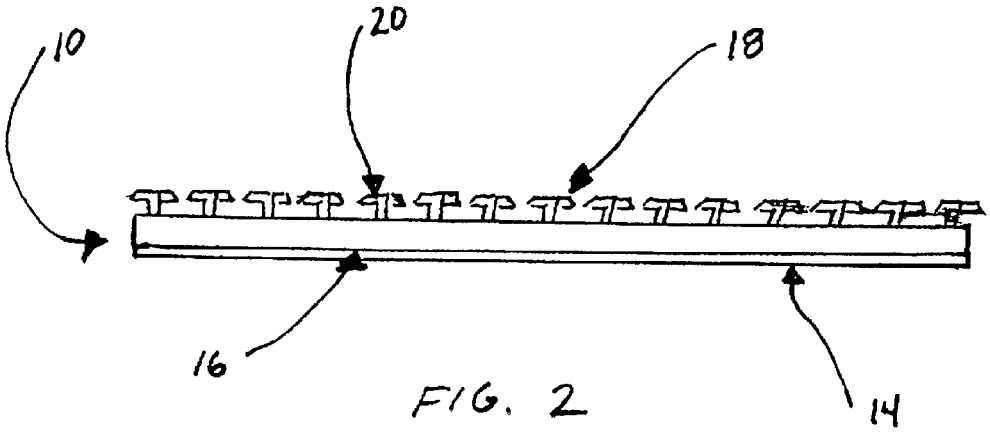
FIG. 2. depicts a cross-section of an apparel attachment member.
Figure 3:
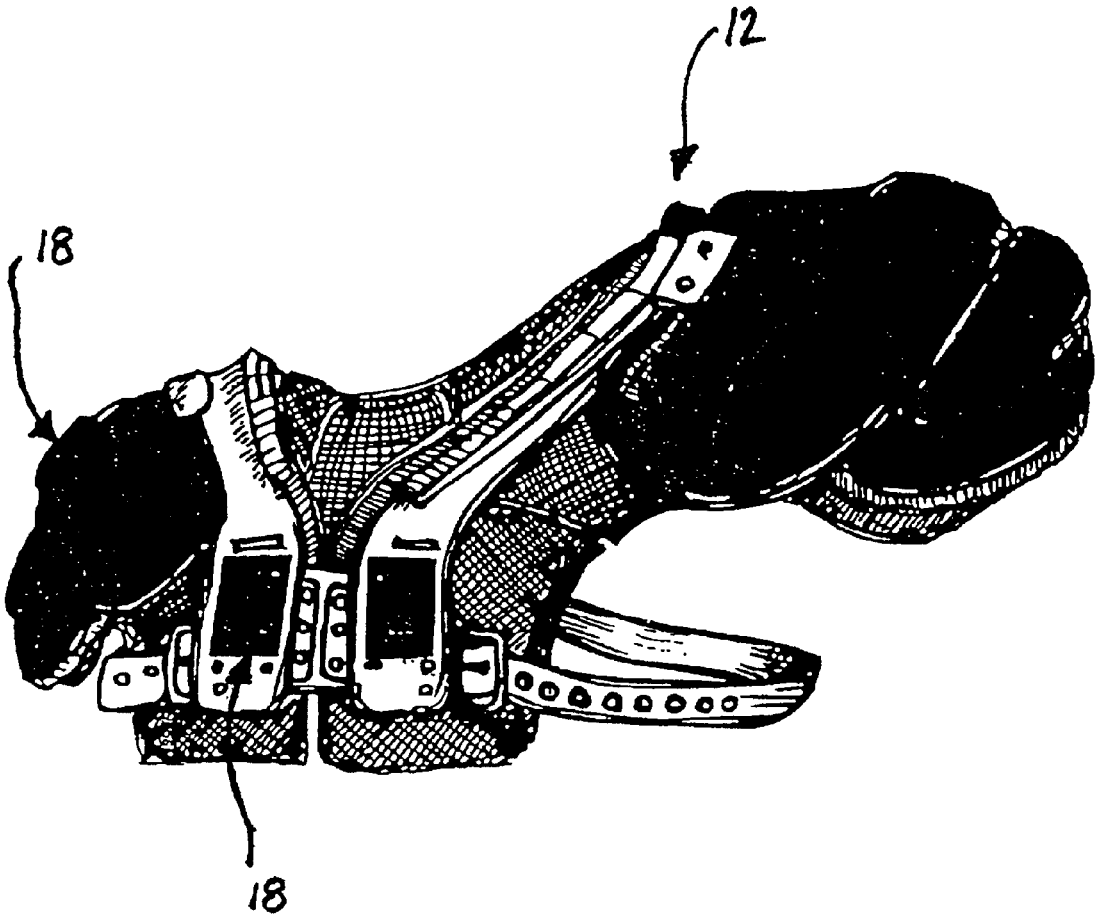
FIG. 3 depicts the apparel attachment members of FIG. 1 in combination with football shoulder pads.
Figure 4:
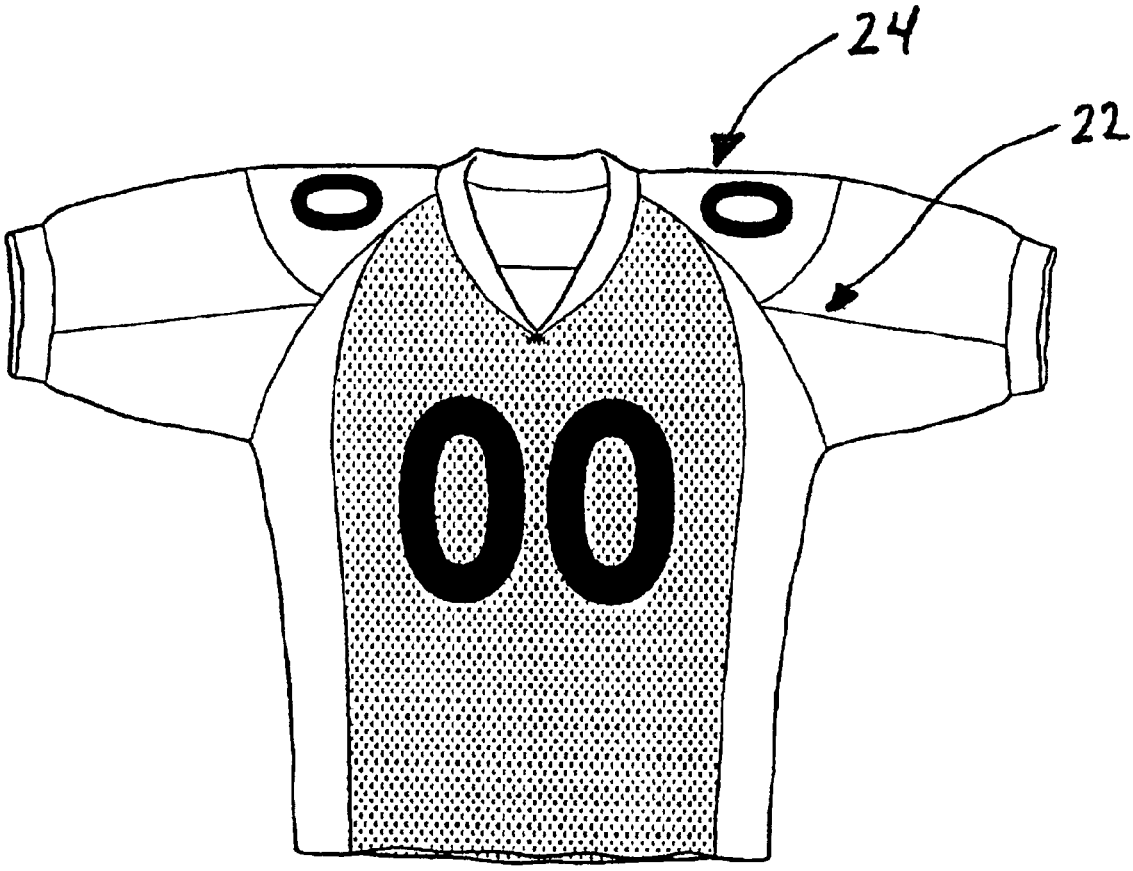
FIG. 4 depicts a sports jersey capable of being used with the present invention.

Referring to the figures, the present invention relates to a device for securing apparel to protective equipment. In an exemplary embodiment, the device comprises an apparel attachment member 10 that may be attached to protective equipment 12. As depicted, the apparel attachment member 10 may be cut to a desired shape to configure to a particular size of protective equipment 12. For example, the apparel attachment member may be die cut to configure to a particular size and shape of football shoulder pads, rib pads, back pads, or other protective equipment. It will be understood by those skilled in the art that various cut shapes of the apparel attachment member may be used with the present invention and that the particular configurations depicted in the figures are merely an exemplary embodiment.

In one embodiment, the apparel attachment member 10 defines a first side 14 having an adhesive coating 16 and a second side 18 having a plurality of hooks 20. The adhesive coating 16 on the first side 14 of the attachment member 10 contacts and adheres to the protective equipment 12. The plurality of hooks 20 on the second side 18 of the attachment member 10 contact and removeably engage a plurality of loops 22 located on the inside of apparel 24. In operation, the attachment member 10 secures the apparel 24 to the protective equipment 12, thereby eliminating movement between the apparel 24 and the protective equipment 12.

With respect to the adhesive coating 16, a number of different adhesives may be used with the present invention. In a preferred embodiment, however, acrylic adhesives are preferred since these adhesives do not leave a residue on the protective equipment 12 when removed.

As for the hooks 20, it should be understood that the hooks 20 may have many configurations depending on the particular application. For example, in an exemplary embodiment, the hooks may include the PowerHook™ manufactured by YKK Incorporated. These hooks, preferably made of Nylon 12, have a mushroom shape and exhibit high peel and shear strengths suitable to prevent movement between the apparel and the protective equipment in all directions.

With respect to the fabric of the apparel 24, a number of different types of fabric may be used. However, apparel consisting of Cordura™ or nylon mesh is preferred as these fabrics contain a plurality of naturally occurring loops that serve to engage the plurality of hooks located on the second side of the attachment member 10.

Because the bond between the attachment system and the apparel increases as the number of loops on the apparel increase, the surface of the apparel is preferably brushed or sanded to create additional loops on the apparel. Those skilled in the art, however, will understand that unbrushed or unprocessed apparel can be used with the present invention since most fabrics contain a plurality of naturally occurring loops.

A further embodiment of the present invention relates to a method of securing apparel 24 to protective equipment 12. The method includes the steps of providing an apparel attachment member 10 defining a first side 14 and a second side 18, wherein the first side 14 has an adhesive coating 16 and the second side 16 has a plurality of hooks 20. The method further includes securing the apparel attachment member 10 to the protective equipment 12 by contacting the first side 14 of the attachment member 10 with the protective equipment 12. The method also includes contacting the inside of the apparel 24 with the second side 18 of the attachment member.

The present invention has many advantages and features not present in the prior art. For instance, the apparel attachment system of the present invention is capable of withstanding high shear stresses caused by the apparel being yanked, grabbed, or pulled. Specifically, the hooks are shaped and configured to provide multi-directional adherence when the hooks engage the loops. In addition to being resistant to high shear stresses, the hook and loop system of the present invention is resistant to soil and moisture—making the present invention ideal for outdoor contact sports where the apparel and protective equipment are often exposed to water and dirt.

Significantly, the effectiveness of the hook and loop system increases after each use. That is, additional loops are created on the apparel each time the apparel is peeled off of the attachment member. With the creation of these additional loops, the bond between the apparel and the attachment member increases. As a result, the overall effectiveness of the hook and loop system increases after each use.

It will be recognized by those skilled in the art that the illustrated embodiments can be modified in arrangement and detail without departing from the scope of the present invention. Therefore, to particularly point out and distinctly claim the subject matter regarded as the invention, the following claims conclude the specification.

What is claimed is:

1. A device for securing apparel to protective equipment comprising:

an apparel attachment member defining a first side and a second side, the first side having an adhesive coating for securing the attachment member to the protective equipment, and the second side having a plurality of hooks for removably securing the apparel attachment member to a plurality of loops formed on the inside of the apparel, the apparel attachment member defining a shape that substantially conforms to the protective equipment.

2. The device of claim 1 wherein the protective equipment is selected from the group consisting of shoulder pads, rib pads, and back pads.

3. The device of claim 1 wherein the apparel is an athletic jersey.

4. The device of claim 3 wherein the athletic jersey has a brushed surface.

5. The device of claim 1 wherein the adhesive coating is an acrylic adhesive.

6. A method of securing apparel to protective equipment comprising the steps of:

providing an apparel attachment member defining a first side and a second side, the first side having an adhesive coating, and the second side having a plurality of hooks, securing the apparel attachment member to the protective equipment by positioning the first side of the apparel attachment member in contact with the protective equipment, and positioning the inside of the apparel in contact with the plurality of hooks on the second side of the apparel attachment member, whereby the apparel is securely attached to the protective equipment.

7. The method of claim 6 further comprising the step of sanding the surface of the apparel to thereby create a brushed surface having a plurality of loops.

8. The method of claim 6 wherein the protective equipment is selected from the group consisting of shoulder pads, rib pads, and back pads.

9. The method of claim 6 wherein the apparel is an athletic jersey.

10. A device for securing apparel to protective equipment comprising:

an apparel attachment member secured to the protective equipment, the apparel attachment member including a plurality of hooks for removably securing the apparel attachment member to a plurality of loops formed on the inside of the apparel, the apparel attachment member defining a shape that conforms to the protective equipment.

11. The device of claim 10 wherein the protective equipment is selected from the group consisting of shoulder pads, rib pads, and back pads.

12. The device of claim 10 wherein the apparel is an athletic jersey.

13. The device of claim 10 wherein the apparel attachment member includes an adhesive coating for securing the apparel attachment member to the protective equipment.

14. The device of claim 12 wherein the athletic jersey has a brushed surface.

* * * * *